US006202787B1

(12) United States Patent
Kessler et al.

(10) Patent No.: US 6,202,787 B1
(45) Date of Patent: Mar. 20, 2001

(54) MULTIPIECE INTERFITTING STEPS FOR A SWIMMING POOL

(75) Inventors: Emerich Kessler, Fort Lee; Arie Wilensky, Livingston, both of NJ (US)

(73) Assignee: Skyller Associates L.L.C., Linvingston, NJ (US)

( * ) Notice: Subject to any disclaimer, the term of this patent is extended or adjusted under 35 U.S.C. 154(b) by 0 days.

(21) Appl. No.: 09/407,435

(22) Filed: Sep. 29, 1999

Related U.S. Application Data

(63) Continuation-in-part of application No. 09/192,156, filed on Nov. 13, 1998, now Pat. No. 5,992,563.

(51) Int. Cl.[7] ..... E06C 7/18

(52) U.S. Cl. ..... 182/106; 182/33.5; 297/440.1

(58) Field of Search ..... 182/106, 33.5, 182/33; 297/118, 1, 423.1, 440.1, 440.14, 248, 440.15, 440.2, 440.24; D25/65; D6/350, 352

(56) References Cited

U.S. PATENT DOCUMENTS 934,316 9/1909 Jones .
2,805,703 9/1957 Wise .
3,826,336 7/1974 Cramer .
4,537,282 8/1985 Lobdell .

*Primary Examiner*—Daniel P. Stodola
*Assistant Examiner*—Hugh B. Thompson
(74) *Attorney, Agent, or Firm*—Richard M. Goldberg

(57) ABSTRACT

A step assembly for a swimming pool, includes a unitary, one-piece, molded plastic, stand alone, lower step section including two steps, an upper platform at least as high as an uppermost one of the steps, a first supporting structure for supporting the two steps and the upper platform on a ground surface as a stand alone unit without any further supporting structure, a first hollow chamber defined between the first supporting structure, the two steps and the upper platform, and a first opening in the first supporting structure permitting access to the first hollow chamber; a unitary, one-piece, molded plastic upper step section including an upper step at a height greater than the upper platform, a second supporting structure for supporting the upper step on the upper platform, a second hollow chamber defined between the second supporting structure and the upper step, and a second opening in the second supporting structure for permitting water access to the second hollow chamber, the upper step section having dimensions less than the first opening so as to be inserted through the first opening when disassembled from the lower step section and so as to be entirely removably positioned in the first hollow chamber in a disassembled position for storage and shipping; and a securing assembly which removably secures the upper step section on the upper platform of the lower step section in an assembled position.

15 Claims, 16 Drawing Sheets

MULTIPIECE INTERFITTING STEPS FOR A SWIMMING POOL

REFERENCE TO RELATED APPLICATION

The present application is a continuation-in-part of U.S. patent application Ser. No. 09/192,156, filed Nov. 13, 1998 which issued into U.S. Pat. No. 5,992,563 on Nov. 30, 1999, for MULTIPIECE INTERFITTING STEPS FOR A SWIMMING POOL by the same inventors herein.

BACKGROUND OF THE INVENTION

The present invention relates generally to swimming pools, and more particularly, is directed to multipiece interfitting steps for a swimming pool.

A problem with swimming pools, and particularly, above-ground swimming pools is the accessability for elderly and infirm people. Generally, a ladder is provided for entering and leaving the swimming pool. However, elderly and infirm people find such ladders difficult to manage. In addition, such ladders are not very sturdy, so that such people can easily fall or lose their balance.

In order to overcome these problems, a one-piece plastic molded step assembly has been provided which fits into the pools, and which is weighted down by sand bags or the like. The advantage is that elderly and infirm people can walk down the steps, from a deck into the above-ground swimming pool, or into an in-ground pool, with little difficulty. Such step assembly is relatively sturdy, and generally provides three or four steps, along with one or two handrails secured to the step assembly that can be held by the person.

A problem with such step assemblies, however, is that they are very bulky. Therefore, in addition to being difficult to manage, that is, difficult to set up or insert into the pool, such step assemblies are difficult to ship because of the large size thereof. As a result, the shipping costs are relatively high compared to the cost of the step assembly itself.

OBJECTS AND SUMMARY OF THE INVENTION

Accordingly, it is an object of the present invention to provide a step assembly for swimming pools that overcomes the problems with the aforementioned prior art.

It is another object of the present invention to provide a step assembly for swimming pools that can be easily handled during set-up.

It is still another object of the present invention to provide a step assembly for swimming pools that is provided in multiple pieces that interfit with each other.

It is yet another object of the present invention to provide a step assembly for swimming pools in which the pieces can fit within each other, substantially reducing the size and bulk of the step assembly for shipping and storage.

It is a further object of the present invention to provide a step assembly for swimming pools that has high structural integrity when assembled.

It is a still further object of the present invention to provide a step assembly for swimming pools that is easy and economical to use and manufacture.

In accordance with an aspect of the present invention, a step assembly for a swimming pool, includes a unitary, one-piece, molded plastic, stand alone, lower step section including at least one lower step, each at least at a first height, an upper platform at least as high as an uppermost one of the at least one lower step, a first supporting structure for supporting the at least one lower step and the upper platform on a ground surface as a stand alone unit without any further supporting structure, a first hollow chamber defined between the first supporting structure, the at least one lower step and the upper platform, and a first opening in a wall of the lower step section for permitting access to the first hollow chamber. A unitary, one-piece, molded plastic upper step section includes at least one upper step, each upper step at a height greater than the upper platform, a second supporting structure for supporting the at least one upper step on the upper platform, a second hollow chamber defined between the second supporting structure and the at least one upper step, and a second opening in the second supporting structure for permitting water access to the second hollow chamber when the step assembly is positioned in a swimming pool. The upper step section has dimensions less than the first opening so as to be inserted through the first opening when disassembled from the lower step section and so as to be entirely removably positioned in the first hollow chamber in a disassembled position for storage and shipping. A securing assembly removably secures the upper step section with the lower step section in an assembled position such that the second supporting structure is removably mounted on the upper platform and such that the steps of the lower step section and the upper step section form a sequential order of steps of different heights from a low height to a higher height.

The at least one lower step includes two steps of different heights which are offset from each other in a horizontal direction and which are connected to each other by a riser.

There is also at least one hand rail, and the lower step section further includes hand rail holding sections for holding the at least one hand rail thereon. Specifically, there are at least two hand rail holding sections, each including a cup-shaped wall for receiving an end of one hand rail therein.

Preferably, the lower step section has a sector shape in plan view, and the first supporting structure includes an arcuate front wall connected with the at least one lower step, and first and second side walls connected with the at least one lower step and having first ends connected with the arcuate front wall and opposite second ends connected with each other. The first supporting structure further includes a bottom wall connecting lower edges of the front wall and the side walls, the bottom wall having the first opening therein, with the first opening being a sector shaped opening.

The upper step section also has a sector shape in plan view, and the second supporting structure includes an arcuate front wall connected with the at least upper step, and first and second side walls connected with the at least one upper step and having first ends connected with the arcuate front wall and opposite second ends connected with each other. The second supporting structure further includes a bottom wall connecting lower edges of the front wall and the side walls. The bottom wall rests on the upper platform in the assembled position.

The securing assembly includes a first securing device on the upper platform; and a second securing device on the second supporting structure for engaging with the first securing device to releasably secure the upper step section with the lower step section. Specifically, the first securing device includes an upper opening in the platform, and the second securing device includes a dowel member integrally formed with the bottom wall as a one-piece member and which removably fits within the upper opening in the assembled position. The first securing device further includes a cup-shaped member at an underside of the upper platform and within the first chamber, the cup-shaped member surrounding the upper opening and being in open communication therewith at an upper edge of the cup-shaped member, for receiving the dowel member inserted through the upper opening. The dowel member has similar dimensions and shape to the cup-shaped member so as to removably fit within the cup-shaped member with a friction fit.

Further, two step assemblies can be connected together to form a larger step assembly.

The above and other objects, features and advantages of the present invention will become readily apparent from the following detailed description thereof which is to be read in connection with the accompanying drawings.

DETAILED DESCRIPTION

Figure 1:
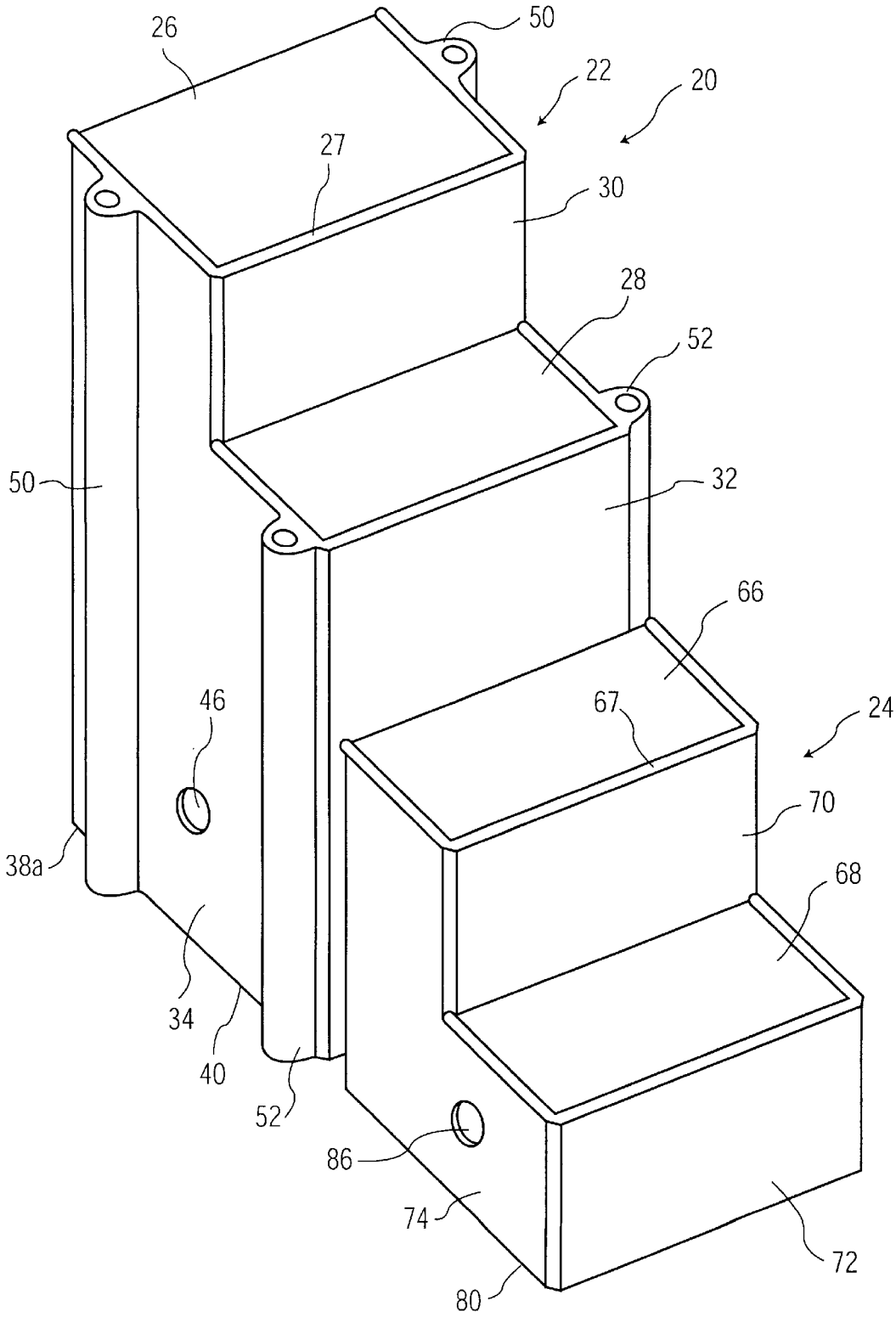
FIG. 1 is a perspective view of a step assembly for swimming pools according to the present invention, in fully assembled condition.
Figure 2:
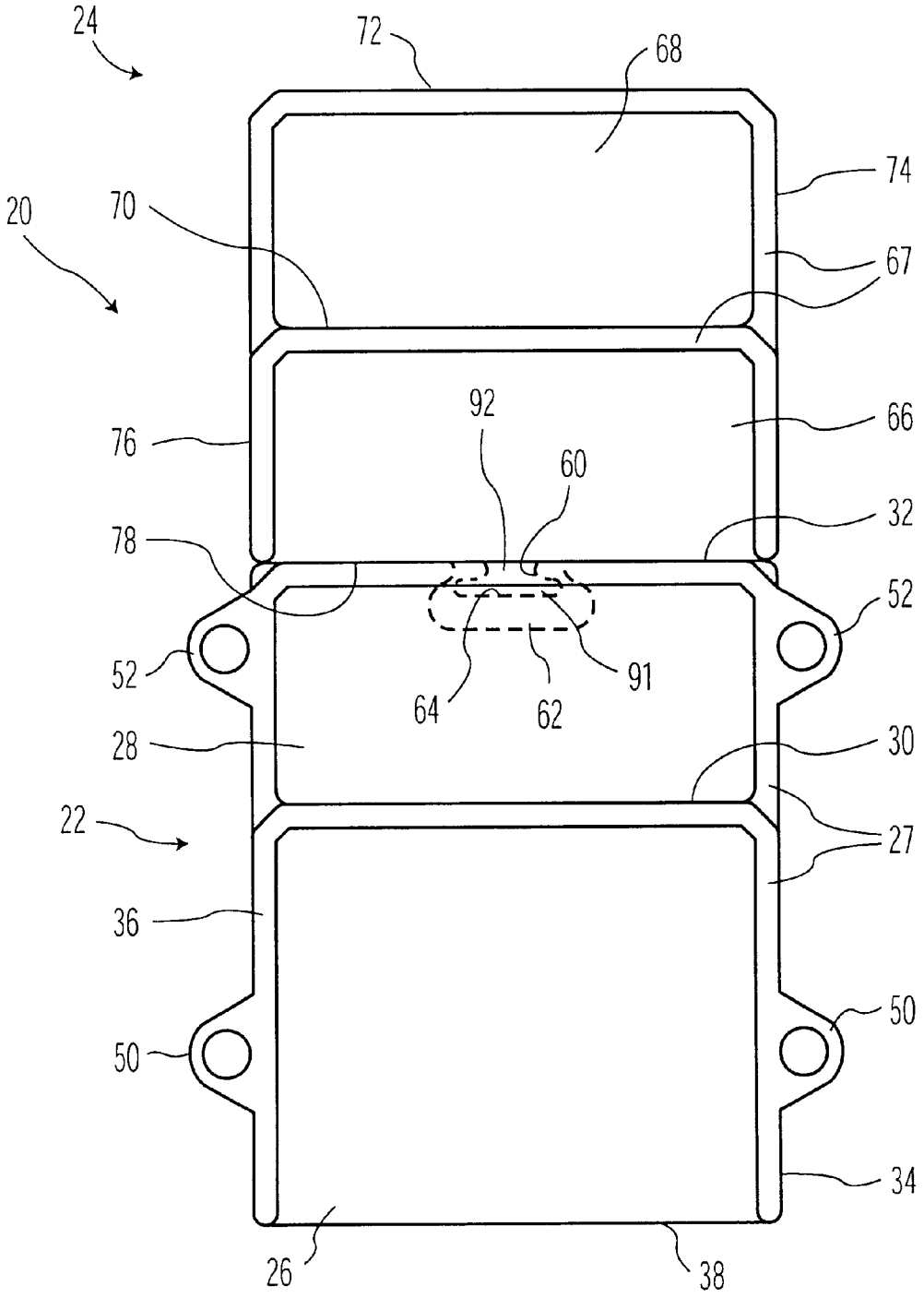
FIG. 2 is a top plan view of the step assembly of FIG. 1.

Referring to the drawings in detail, and specifically to FIGS. 1–16, a step assembly 20 for swimming pools according to the present invention, is shown to include an upper step section 22 and a lower step section 24 which can detachably interfit with each other to form step assembly 20. Upper step section 22 and lower step section 24 are formed from a relatively tough, thin walled, molded plastic material. Therefore, as will be appreciated from the discussion hereinafter, upper step section 22 and lower step section 24 each have a hollow interior to reduce the weight thereof and to reduce the size thereof during shipping and storage.

Figure 11:
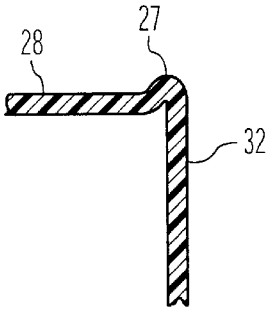
FIG. 11 is a cross-sectional view of the upper step section, taken along line 11—11 of FIG. 5.
Figure 12:
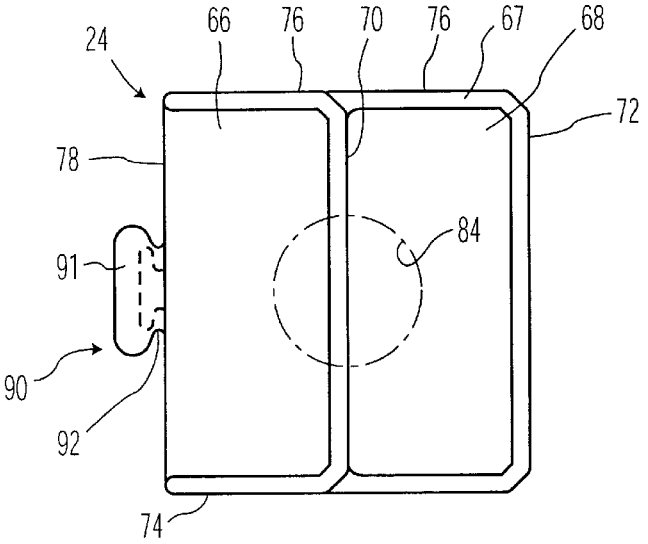
FIG. 12 is a top plan view of the lower step section of the step assembly of FIG. 1.
Figure 13:
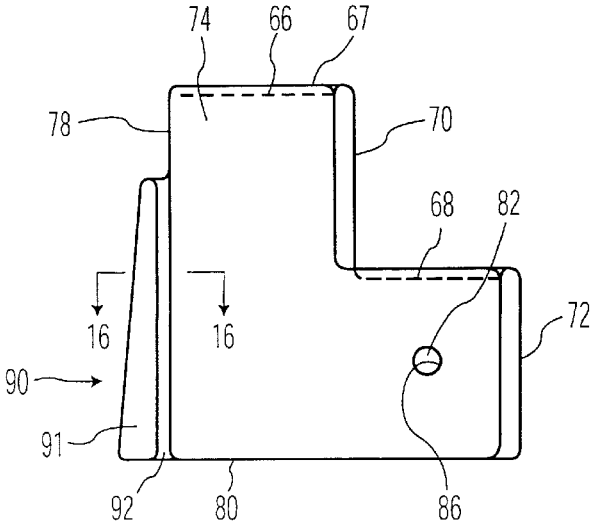
FIG. 13 is a left side elevational view of the lower step section of FIG. 12.
Figure 14:
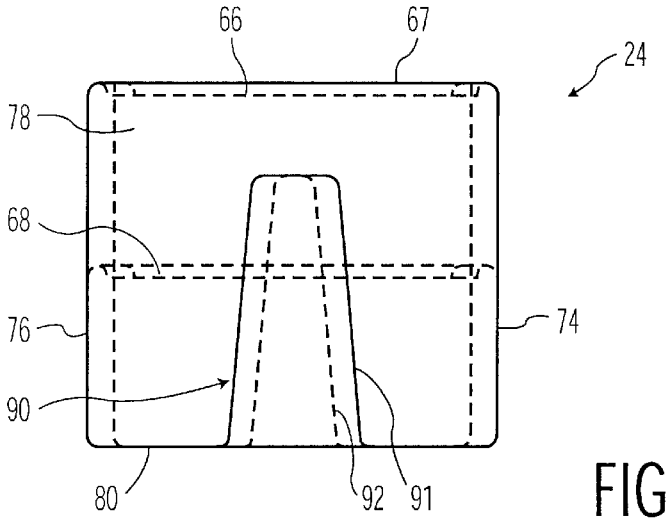
FIG. 14 is a rear elevational view of the lower step section of FIG. 12.
Figure 15:
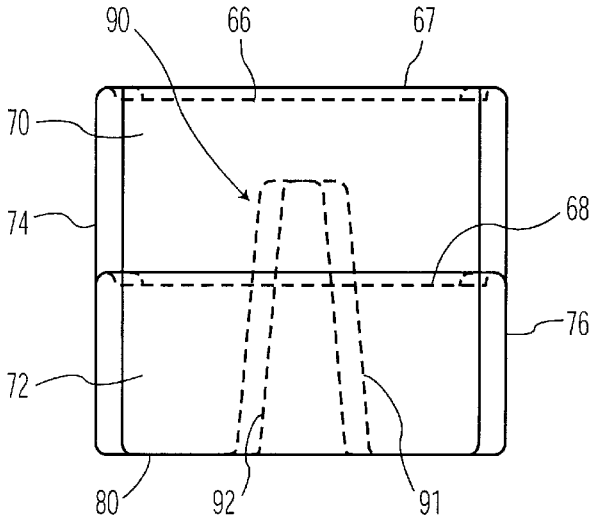
FIG. 15 is a front elevational view of the lower step section of FIG. 5.
Figure 16:
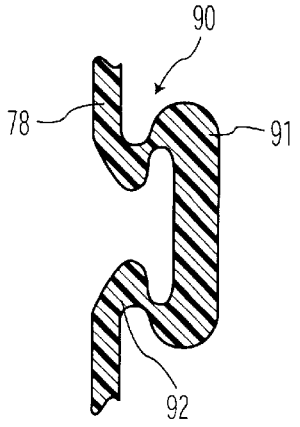
FIG. 16 is a cross-sectional view of the lower section, taken along line 16—16 of FIG. 15.
Figure 17:
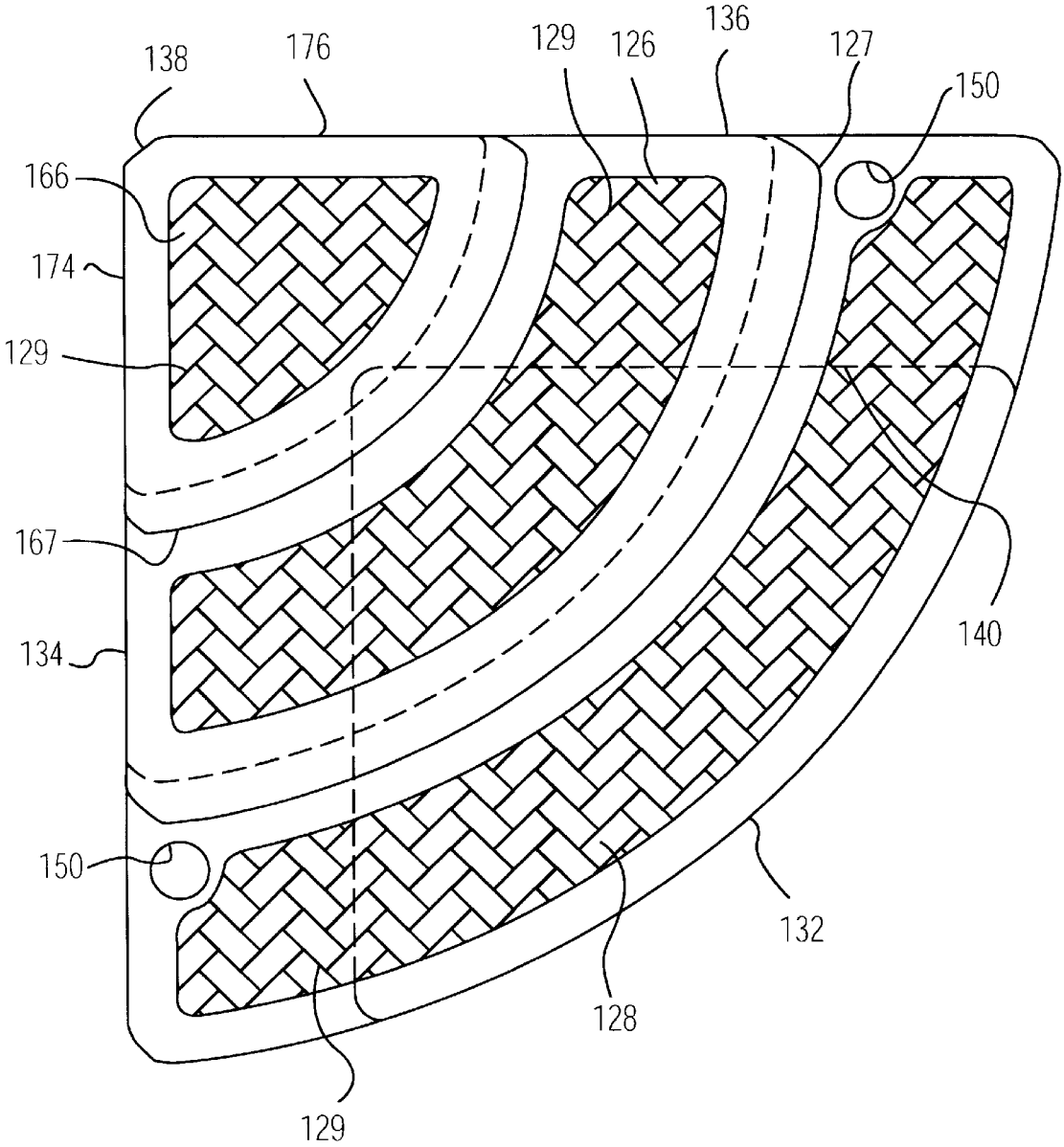
FIG. 17 is a top plan view of a sector shaped step assembly for swimming pools according to a second embodiment of the present invention, in fully assembled condition.

Referring initially to FIGS. 1–11, upper step section 22 includes at least one step, and preferably, a plurality of steps. Upper step section 22 is shown with an uppermost step 26 and a next lower step 28, although the present invention is not limited to two steps. Steps 26 and 28 are formed in a substantially rectangular configuration, although the present invention is not limited thereto, and therefore, steps 26 and 28 can be formed in any other suitable configuration, such as circular, oval, arcuate, etc. Steps 26 and 28 are provided in parallel, vertically spaced relation, with step 26 being higher than step 28, and with the front edge of step 26 being aligned with the rear edge of step 28, and connected thereat by a vertical riser 30. In addition, as best shown in FIG. 11, each step 26 and 28 has a raised edge 27 at the front and side edges thereof to prevent slipping by a person, and the upper surface of each step 26 and 28 can include ribs or the like (not shown) to further prevent slipping.

A supporting structure for supporting steps 26 and 28 above a ground surface is provided by a vertical front wall or front riser 32, left and right vertical side walls 34 and 36, and a vertical rear wall 38. Front riser 32 is connected at its upper edge to the front edge of step 28, and its lower edge provides support for upper step section 22 on a ground surface. Left and right vertical side walls 34 and 36 are connected at their front edges to the side edges of front riser 32, and are shaped at their upper edges to conform to the shape of uppermost step 26, riser 30 and the next lower step 28, and connected therewith. Vertical rear wall 38 has side edges connected to the rear edges of left and right vertical side walls 34 and 36, and an upper edge connected to the rear edge of uppermost step 26. The lower portion 38*a* of vertical rear wall 38 is inclined inwardly toward front riser 32 in order to accommodate the cove at the lower edge of the swimming pool.

The supporting structure also includes a bottom wall 40 connected at its edges to the lower edges of front riser 32, left and right vertical side walls 34 and 36, and lower portion 38*a* of vertical rear wall 38.

As discussed above, upper step section 22 is made from a thin walled, plastic material, and therefore forms a hollow chamber 42 therein.

When upper step section 22 is placed in the water in a swimming pool, it is necessary that the water be displaced. In order to aid in the insertion of upper step section 22, and the displacement of the water, bottom wall 40 has a large opening 44 therein by which the water beneath bottom wall 40 can escape into chamber 42. In addition, side walls 34 and 36 can be provided with openings 46 to relieve the pressure on side walls 34 and 36 during such insertion.

Further, according to an important aspect of the present invention, rear wall 38 includes a large rectangular opening 48 which serves a dual purpose of allowing entry and removal of lower step section 24 into chamber 42 during shipping and storage of step assembly 20, and also provides for the egress of water that has entered chamber 42 through bottom opening 44 during insertion of upper step section 22 in the water.

Figure 7:
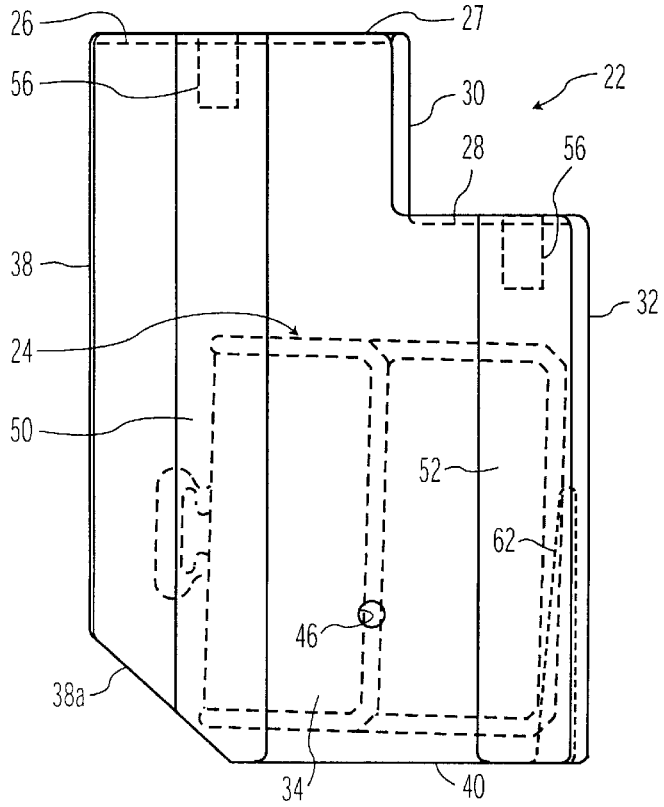
FIG. 7 is a left side elevational view of the upper step section of FIG. 5.
Figure 8:
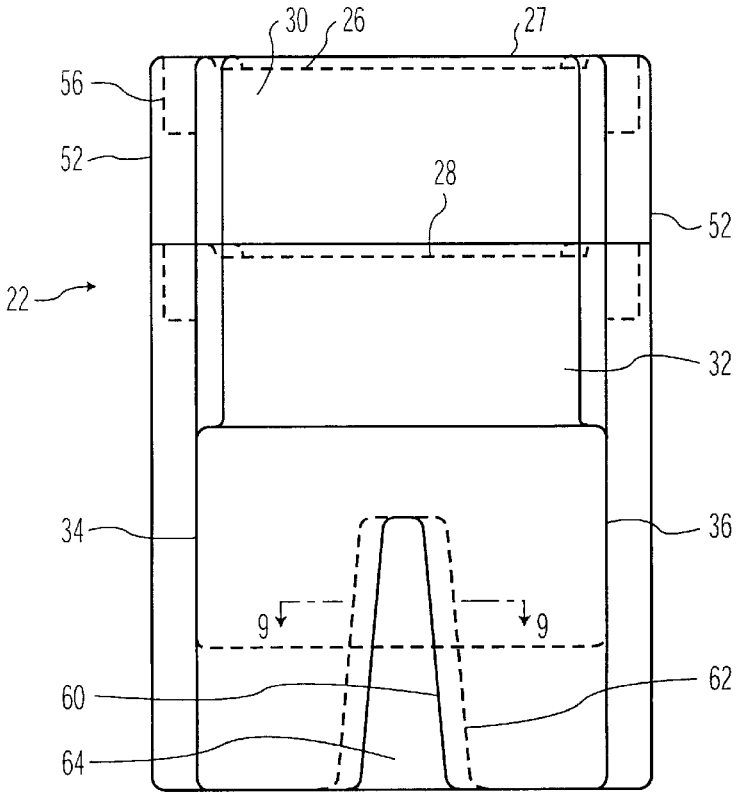
FIG. 8 is a front elevational view of the upper step section of FIG. 5.
Figure 9:
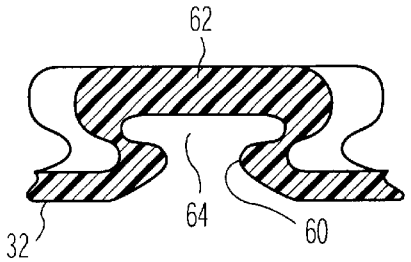
FIG. 9 is a cross-sectional view of the upper step section, taken along line 9—9 of FIG. 8.
Figure 10:
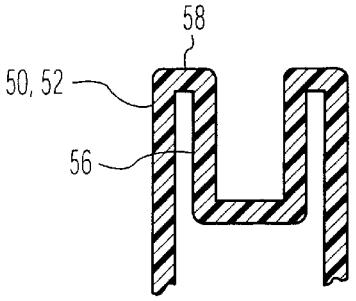
FIG. 10 is a cross-sectional view of the upper step section, taken along line 10—10 of FIG. 5.

It will be appreciated that, with lower step section 24 inserted into upper step section 22, as shown in FIG. 7, the entire shipping dimensions of step assembly 20 are the same as those of upper step section 22 only. This substantially reduces the bulk and size of step assembly 20 to be shipped, so that step assembly 20 can be shipped in conventional packaging, for example, by United Parcel Service (UPS), thereby greatly reducing the shipping costs of step assembly 20 in comparison to a comparable step assembly which is a one piece unit.

Figure 3:
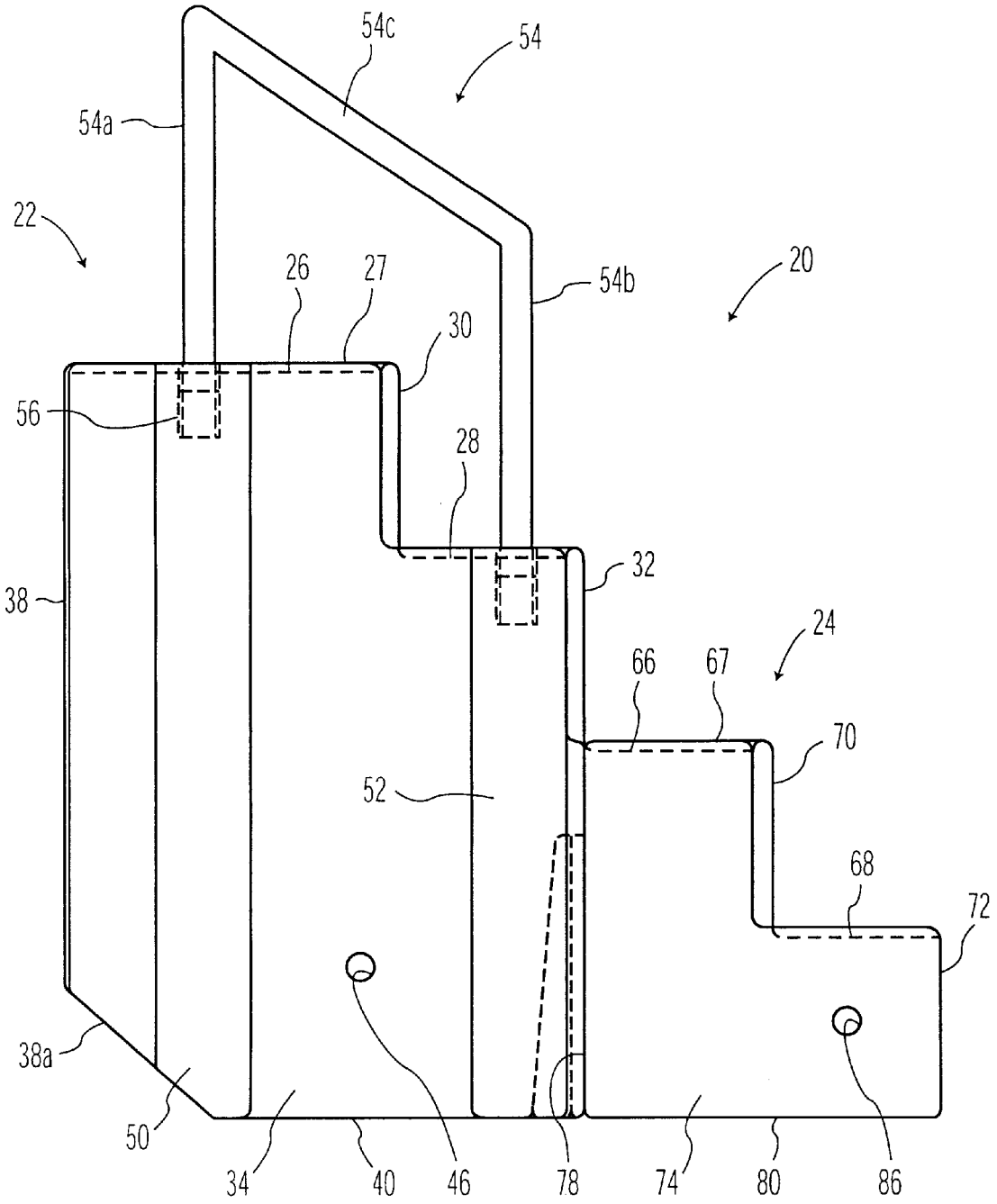
FIG. 3 is left side elevational view of the step assembly of FIG. 1.
Figure 4:
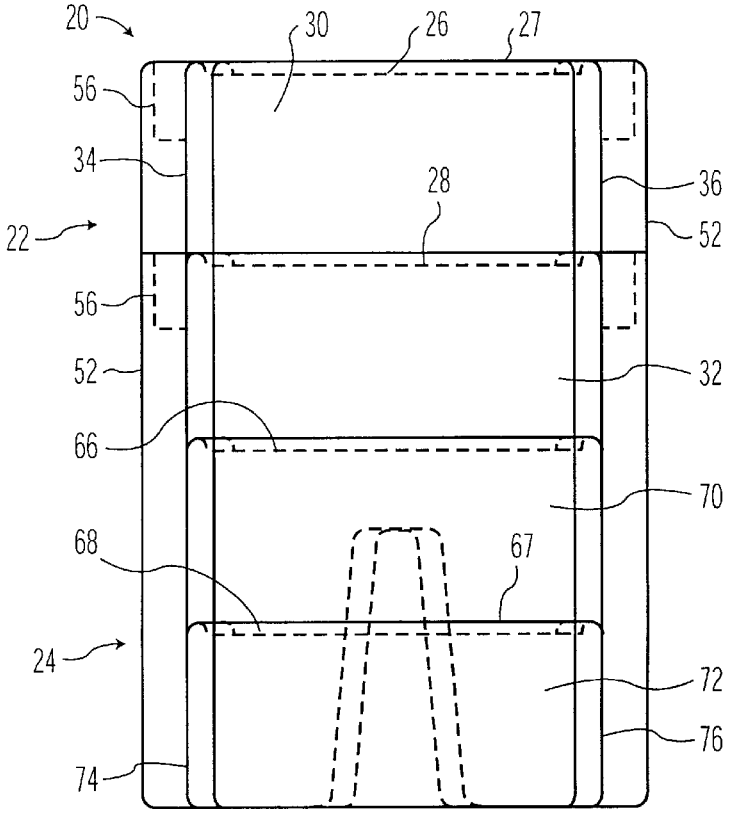
FIG. 4 is a front elevational view of the step assembly of FIG. 1.
Figure 5:
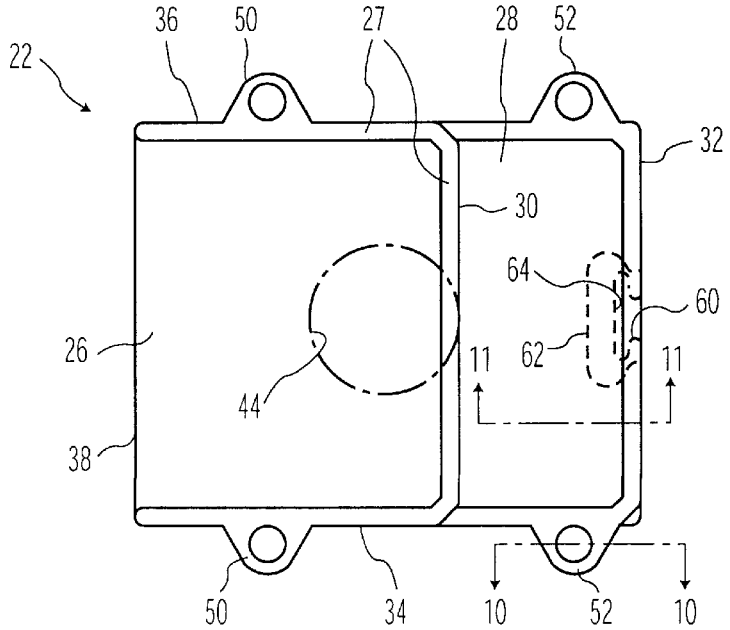
FIG. 5 is a top plan view of the upper step section of the step assembly of FIG. 1.
Figure 6:
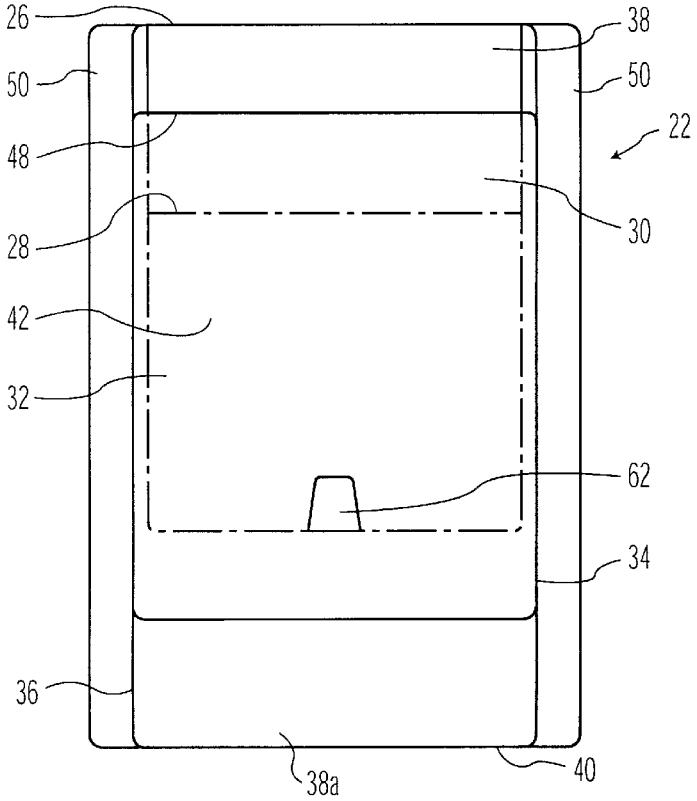
FIG. 6 is a rear elevational view of the upper step section of FIG. 5.

Upper step section 22 further includes hollow, thin walled semi-cylindrical sections 50 and 52 for holding hand rails 54, as shown in FIG. 3, and for further aiding in the support of upper step section 22 on a ground surface. Specifically, there are two sections 50 integrally formed at outer surfaces of side walls 34 and 36 adjacent uppermost step 26, and two sections 52 integrally formed at outer surfaces of side walls 34 and 36 adjacent next lower step 28. A cup-shaped, cylindrical wall 56 is positioned in each section 50 and 52, and has an upper annular connecting wall 58 connected with the upper edge of each section 50 and 52. Accordingly, cup-shaped, cylindrical walls 56 support the ends of hand rails 54 therein, and also limit the extent that such ends can travel within semi-cylindrical sections 50 and 52, that is, to accurately position hand rails 54 at a particular location.

As shown in FIG. 3 only, each hand rail 54 includes a first vertical section 54*a*, a second vertical section 54*b* and an inclined connecting section 54*c* such that the respective upper and lower ends of vertical section 54*b* are positioned lower than the upper and lower ends of vertical section 54*a*. In this regard, the lower ends of vertical sections 54*a* fit within cup-shaped cylindrical walls 56 associated with semi-cylindrical sections 50 and the lower ends of vertical sections 54*b* fit within cup-shaped cylindrical walls 56 associated with semi-cylindrical sections 52. Thus, a person walking up or down the steps can grasp hand rails 54 for better support. Screws or bolts can be provided through sections 50 and 52, and through cylindrical walls 56, and then through hand rails 54 to lock the same in place.

In accordance with another important aspect of the present invention, front riser 32 is provided with an elongated vertical groove 60, which is open at the lower edge of front riser 32. Preferably, groove 60 has a trapezoidal configuration such that the side edges of groove 60 converge toward each other in an upward direction, although the present invention is not limited thereto. A substantially C-shaped guiding wall 62 is integrally formed at the inner surface of front riser 32 and extends the entire height of groove 60. Preferably, C-shaped guiding wall 62 inclines away from front riser 32 in a downward direction, thereby defining a substantially oval chamber 64 therein, which is in open communication with groove 60 and which decreases in size from a lower end to an upper end thereof. Groove 60 and guiding wall 62 serve to removably connect lower step section 24 to the front of upper step section 22, as will be explained hereinafter.

Referring now to FIGS. 12–16, lower step section 24 includes at least one step, and preferably, a plurality of steps. Lower step section 24 is shown with an uppermost step 66 and a next lower step 68, although the present invention is not limited to two steps. Steps 66 and 68 are formed in a substantially rectangular configuration, although the present invention is not limited thereto, so that steps 66 and 68 can be formed in any other suitable configuration, such as circular, oval, arcuate, etc. Steps 66 and 68 are provided in parallel, vertically spaced relation, with step 66 being higher than step 68, and with the front edge of step 66 being aligned with the rear edge of step 68, and connected thereat by a vertical riser 70. It will be appreciated that uppermost step 66 is lower than step 28 of upper step section 22, and forms a next step after step 28 of step assembly 20.

In addition, in the same manner as shown in FIG. 11, each step 66 and 68 has a raised edge 67 at the front and side edges thereof to prevent slipping by a person, and the upper surface of each step 66 and 68 can include ribs or the like (not shown) to further prevent slipping.

A supporting structure for supporting steps 66 and 68 above a ground surface is provided by a vertical front wall or front riser 72, left and right vertical side walls 74 and 76, and a vertical rear wall 78. Front riser 72 is connected at its upper edge to the front edge of step 68, and its lower edge provides support for lower step section 24 on a ground surface. Left and right vertical side walls 74 and 76 are connected at their front edges to the side edges of front riser 72, and are shaped at their upper edges to conform to the shape of uppermost step 66, riser 70 and the next lower step 68, and are connected therewith. Vertical rear wall 78 has side edges connected to the rear edges of left and right vertical side walls 74 and 76, and an upper edge connected to the rear edge of uppermost step 66.

The supporting structure also includes a bottom wall 80 connected at its edges to the lower edges of front riser 72, left and right vertical side walls 74 and 76, and vertical rear wall 78.

Lower step section 24 is made from a thin walled, plastic material, and therefore forms a hollow chamber 82 therein.

When lower step section 24 is placed in the water in a swimming pool, it is necessary that the water be displaced. In order to aid in the insertion of lower step section 24, and the displacement of the water, bottom wall 80 has a large opening 84 therein by which the water beneath bottom wall 80 can escape into chamber 82. In addition, side walls 74 and 76 are provided with openings 86 to relieve the pressure on side walls 74 and 76 during such insertion.

In accordance with another important aspect of the present invention, rear wall 78 is provided with an elongated vertical tongue 90 having a C-shaped cross-section and integrally formed on the outer surface thereof. Vertical tongue 90 includes a substantially C-shaped main body portion 91 and a reduced neck portion 92 by which main body portion 91 is connected with rear wall 78, and extends to the lower edge of rear wall 78. Preferably, reduced neck portion 92 and main body portion 91 each have a substantially trapezoidal configuration of similar dimensions and shape to groove 60 and oval chamber 64 of guiding wall 62, respectively, such that the side edges of main body portion 91 and reduced neck portion 92 converge toward each other in an upward direction, although the present invention is not limited thereto. Also, main body portion 91 preferably inclines away from rear wall 78 in a downward direction, in a complementary manner to C-shaped guiding wall 62, and thereby decreases in size from a lower end to an upper end thereof. Tongue 90 is removably connectable within groove 60 and chamber 64 in order to removably connect lower step section 24 to the front of upper step section 22.

In order to assemble upper step section 22 and lower step section 24, lower step section 24 is positioned on the floor of the swimming pool. Then, upper step section 22 is positioned in the swimming pool, such that tongue 90 fits within groove 60 and chamber 64. Hand rails 54 can be inserted before or after positioning of upper step section 22 into the swimming pool. Thereafter, sealed bags of sand or other matter are inserted into chamber 42 in upper step section through large rectangular opening 48 in order to weigh down step assembly 20. Alternatively, the sealed bags can be placed in upper and lower step sections 22 and 24 just prior to insertion of the same into the swimming pool. Step assembly 20 can be moved a small amount into position such that rear wall 38 is against the side wall of the swimming pool. It will therefore be appreciated that set up of step assembly 20 is relatively easy.

Further, during storage and during shipping, lower step section 24 fits within upper step section 22, that is, through large rectangular opening 48 of rear wall 38. This is shown in FIG. 7. In order to do so, it is necessary to turn lower step section 24 by 90°, since lower step section 24 is of the same width as upper step section 22. Thus, step assembly 20, during storage and transport, occupies a much smaller space and can be shipped at a greatly reduced cost.

It will be appreciated that various modifications can be made to the invention within the scope of the claims. For example, the shape of step assembly 20 can be changed to a rounded or any other suitable shape. Further, although only two step sections 22 and 24 have been shown, the present invention is not limited thereto, and more than two sections can be provided which interfit within each other.

Further, while the present invention has been described in connection with a tongue and groove arrangement for detachably connecting upper step section 22 and lower step section 24 together, the present invention is not limited thereby. In such case, any other suitable arrangement can be provided, such as a clamp arrangement at the sides of sections 22 and 24, a strap arrangement, a bolt fastening arrangement, etc.

As another variant, tongue 90 can be formed on front wall 32 of upper step section 22, while groove 60 is formed in rear wall 78 of lower step section 24.

Referring now to FIGS. 17–27, a step assembly 120 according to a second embodiment of the present invention, for swimming pools, and particularly, inground swimming pools, will now be discussed. Step assembly 120 is shown to include a lower step section 122 and an upper step section 124 which can detachably interfit with each other to form step assembly 120. Step assembly 120 is formed in a configuration of a one-quarter sector of a circle in plan view and is particularly adapted to be used in a corner of an inground swimming pool. However, the present invention is not limited to this configuration, and step assembly 120 can take any other suitable configuration, such as the configuration of FIGS. 1–16 or the like. Lower step section 122 and upper step section 124 are formed from a relatively tough, thin walled, molded plastic material. Therefore, as will be appreciated from the discussion hereinafter, lower step section 122 and upper step section 124 each have a hollow interior to reduce the weight thereof and to reduce the size thereof during shipping and storage.

Figure 18:
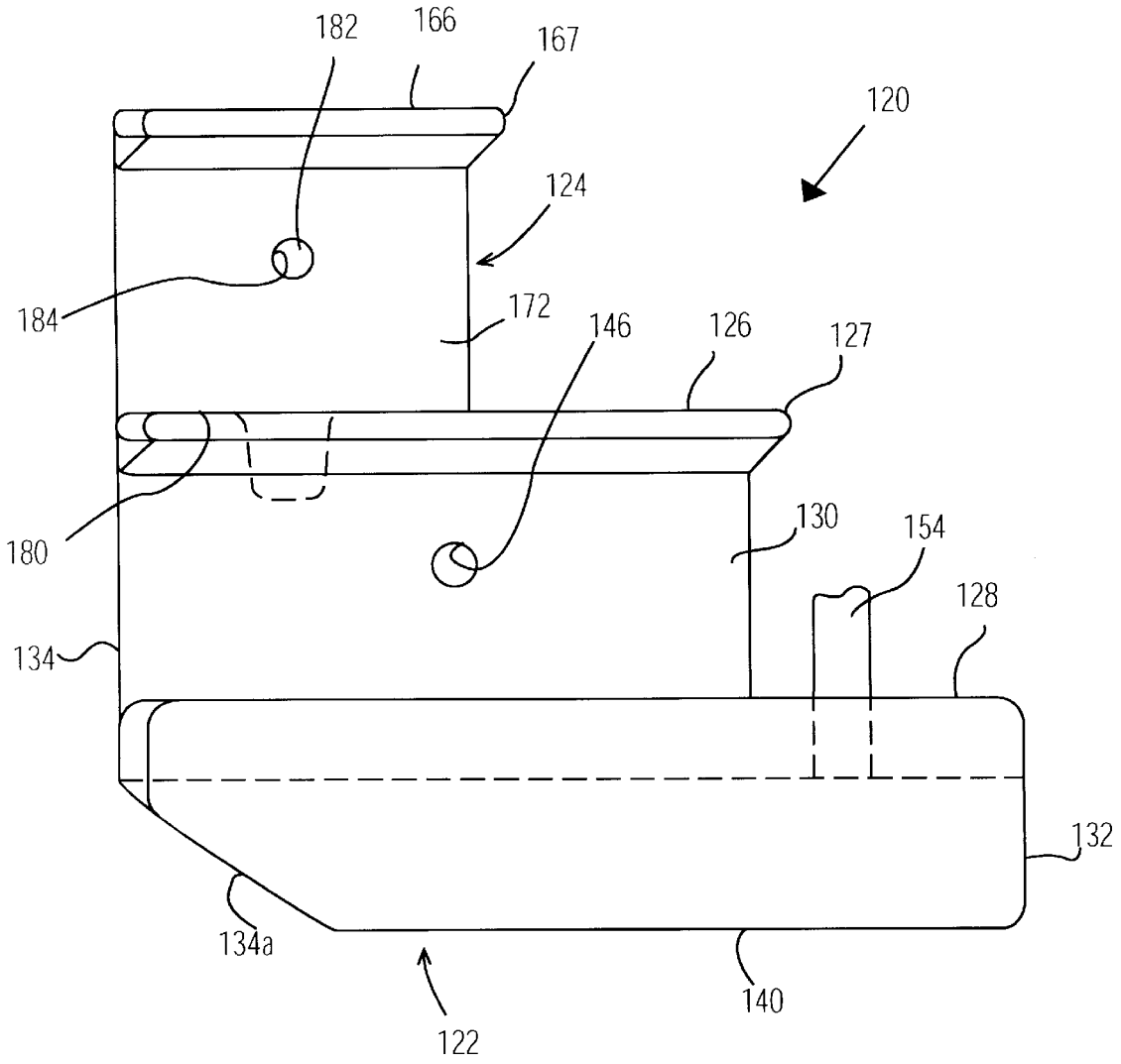
FIG. 18 is side elevational view of the step assembly of FIG. 17.
Figure 19:
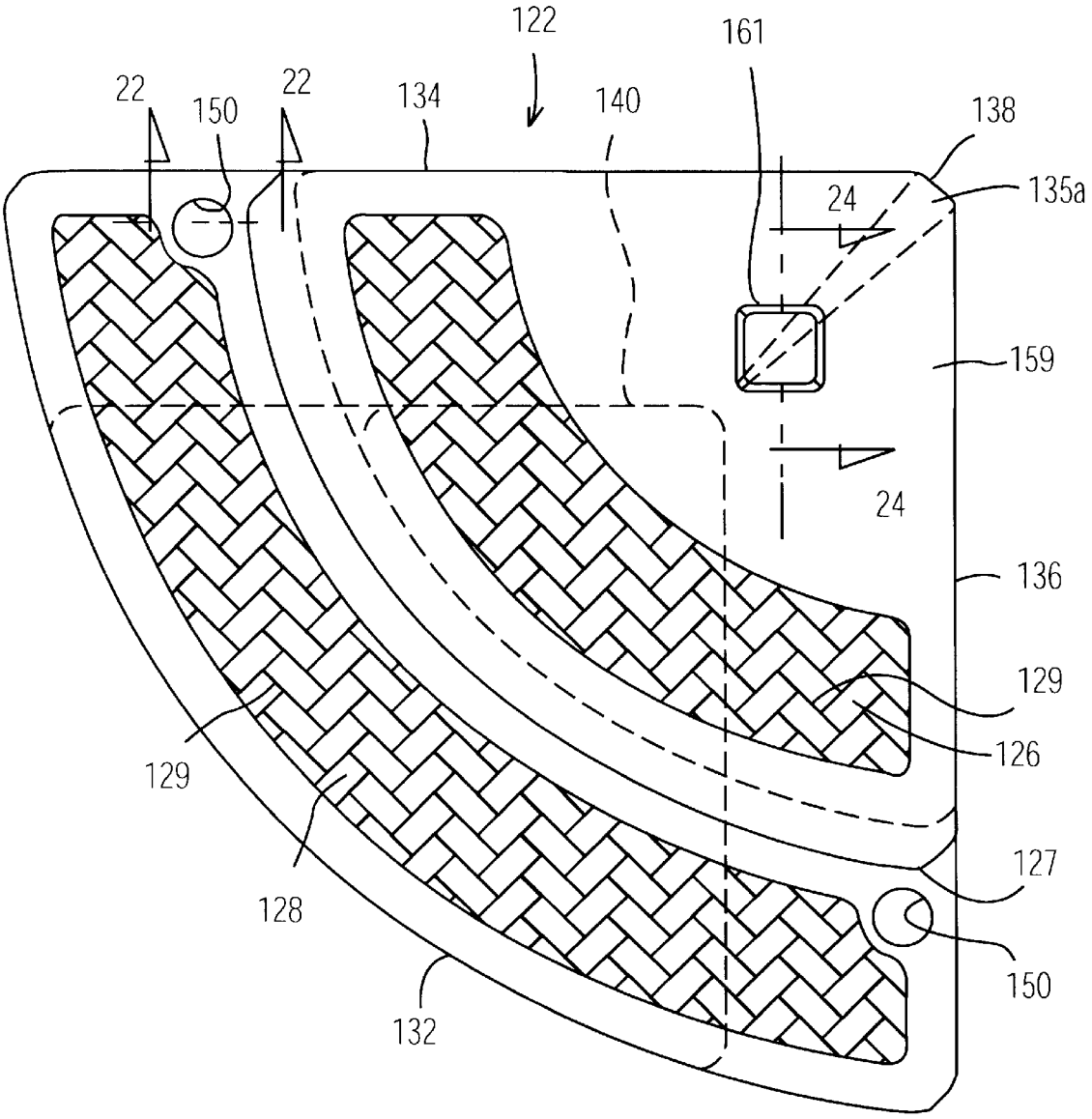
FIG. 19 is a top plan view of the lower step section of the step assembly of FIG. 17.

Referring initially to FIGS. 17–24, lower step section 122 includes at least one step, and preferably, a plurality of steps. Lower step section 122 is shown with an uppermost step 126 and a next lower step 128, although the present invention is not limited to two-steps. Steps 126 and 128 are formed in a configuration of a part annular portion of a circle, although the present invention is not limited thereto, and therefore, steps 126 and 128 can be formed in any other suitable configuration, such as rectangular, oval, etc. Steps 126 and 128 are provided in parallel, vertically spaced relation, with step 126 being higher than step 128, and with the arcuate front edge of step 126 being aligned with the arcuate rear edge of step 128, and connected thereat by an arcuate vertical riser 130. In addition, as best shown in FIG. 18, step 126 has an outwardly extending lip 127 at the front arcuate edge thereof, and the upper surface of each step 126 and 128 can include a non-smooth surface formed by a crisscrossing rectangular pattern (checkerboard tread) 129, ribs or the like, to prevent slipping.

Figure 20:
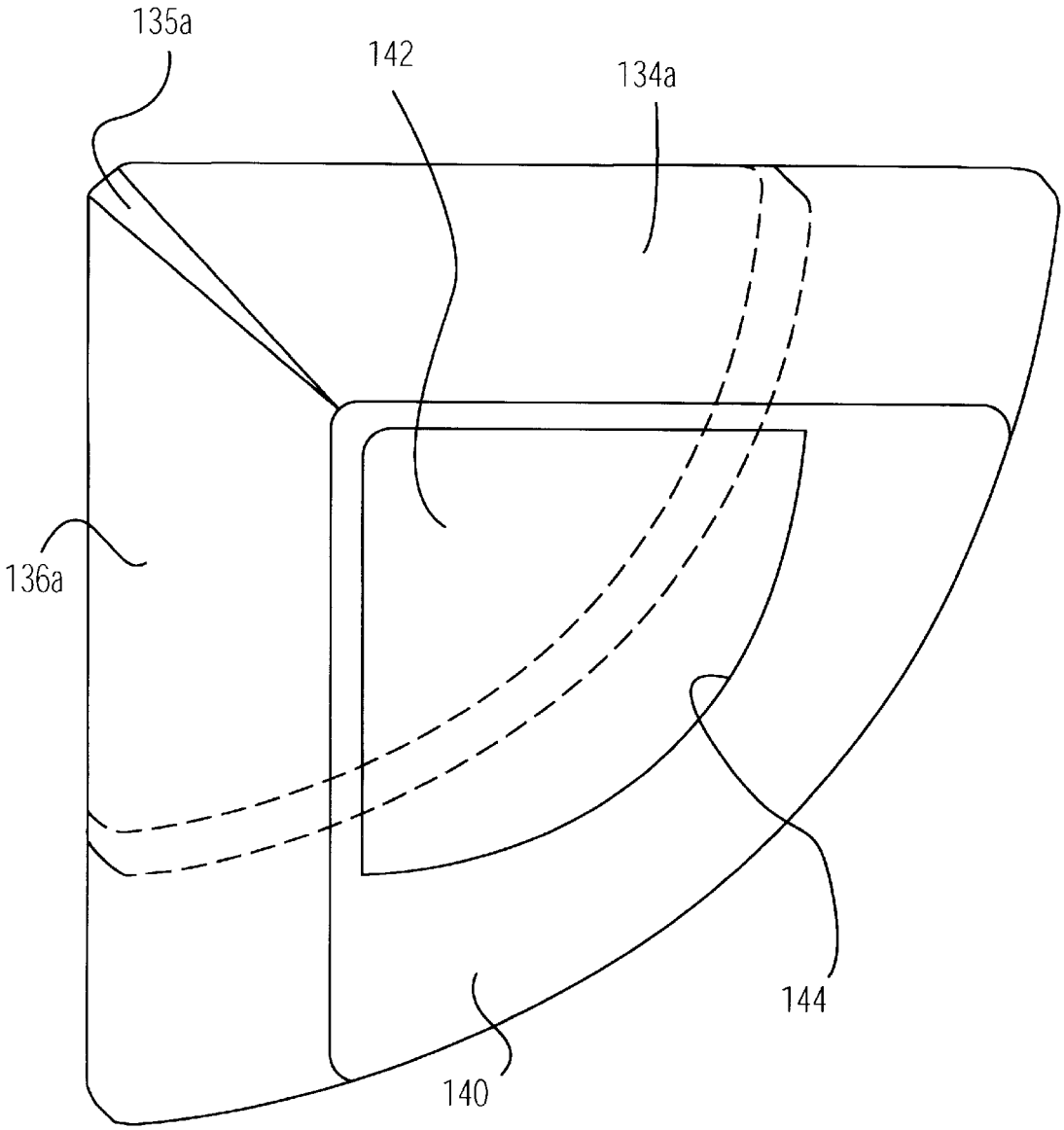
FIG. 20 is a bottom plan view of the lower step section of FIG. 19.
Figure 21:
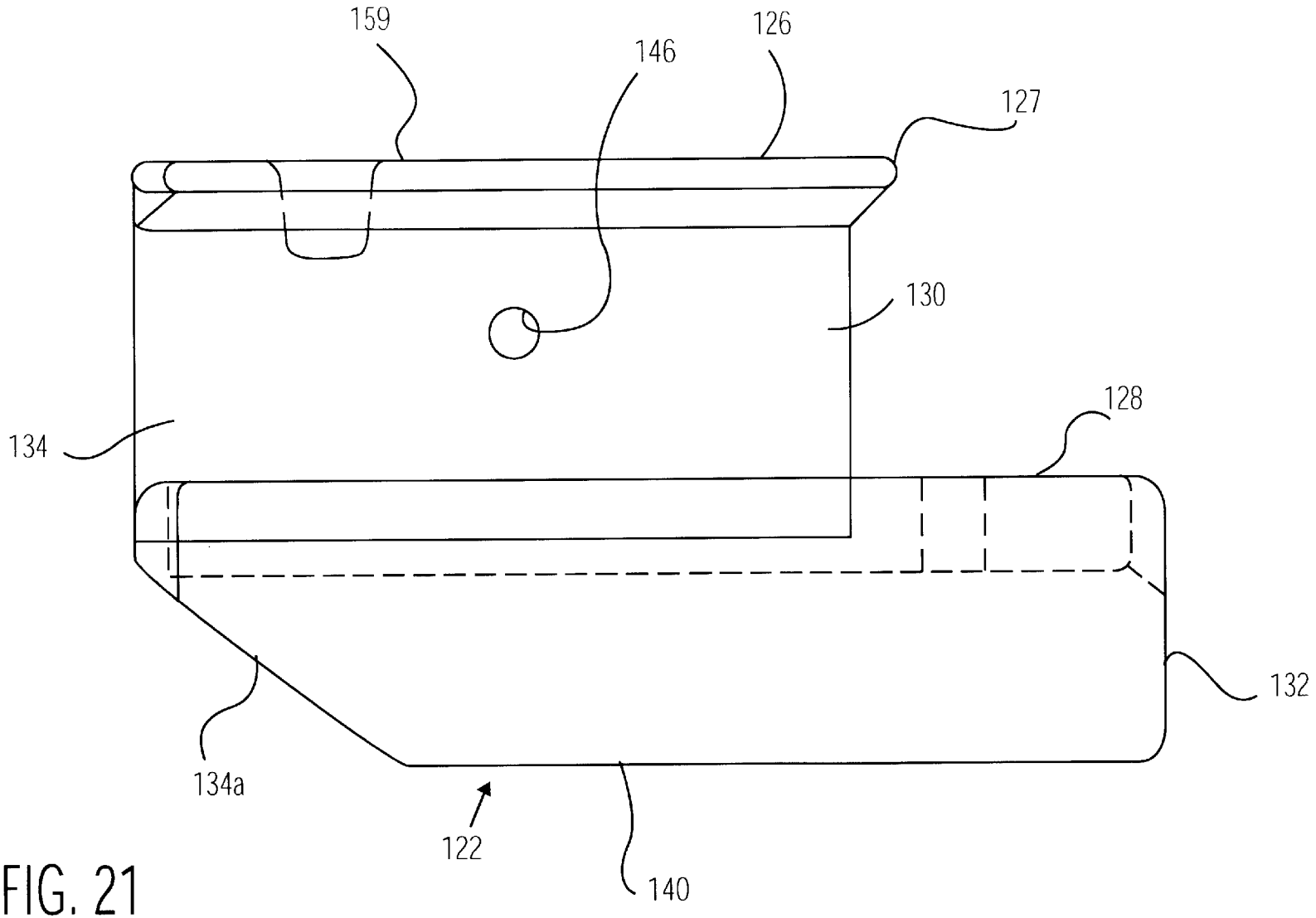
FIG. 21 is a side elevational view of the lower step section of FIG. 17.

A supporting structure for supporting steps 126 and 128 above a ground surface is provided by an arcuate, vertical front wall or front riser 132, and left and right vertical side walls 134 and 136 which meet at a rear vertical corner 138. Front riser 132 is connected at its upper edge to the front edge of step 128, and its lower edge provides support for lower step section 122 on a ground surface. Left and right vertical side walls 134 and 136 are connected at their front edges to the side edges of front riser 132, and are shaped at their upper edges to conform to the shape of uppermost step 126, riser 130 and the next lower step 128, and are connected therewith. The lower portions 134*a* and 136*a* of vertical side walls 134 and 136 are inclined inwardly toward front riser 132 in order to accommodate the cove at the lower edge of the swimming pool. A rear inclined portion 135*a* of a V-shape, as best shown in FIG. 20, connects together the rear edges of lower portions 134*a* and 136*a*.

The supporting structure also includes a one-quarter sector shaped bottom wall 140 connected at its arcuate front edge to the lower edge of front riser 132, and at its planar left and right side edges to the lower edges of lower portions 134*a* and 136*a*, respectively.

As discussed above, lower step section 122 is made from a thin walled, plastic material, and therefore forms a hollow chamber 142 therein.

When lower step section 122 is placed in the water in a swimming pool, it is necessary that the water be displaced. In order to aid in the insertion of lower step section 122, and the displacement of the water, bottom wall 140 has a large one-quarter sector shaped opening 144 therein by which the water beneath bottom wall 140 can escape into chamber 142. In addition, front riser 132 and/or side walls 134 and 136 can be provided with openings 146 to relieve the pressure on front riser 132 and side walls 134 and 136 during such insertion.

Further, according to an important aspect of the present invention, large sector shaped opening 144 serves the additional purpose of allowing entry and removal of upper step section 124 into chamber 142 during shipping and storage of step assembly 120, as well as providing for the egress of water that has entered chamber 142 during insertion of lower step section 122 in the water.

It will be appreciated that, with upper step section 124 inserted into lower step section 122, the entire shipping dimensions of step assembly 120 are the same as those of lower step section 122 only. This substantially reduces the bulk and size of step assembly 120 to be shipped, so that step assembly 120 can be shipped in conventional packaging, for example, by United Parcel Service (UPS), thereby greatly reducing the shipping costs of step assembly 120 in comparison to a comparable step assembly which is a one piece unit.

Lower step section 122 further includes two openings 150 at opposite ends of lower step 128. Thin walled, cup-shaped members 155 each include a cylindrical wall 156 closed by a bottom wall 157 for holding one end of hand rails 154. Cylindrical walls 156 depend down from the underside of lowermost step 128 in surrounding relation to openings 150 and are open only at the upper ends thereof. Accordingly, cup-shaped, cylindrical walls 156 support the ends of hand rails 154 therein, and bottom walls 157 limit the extent that such ends of hand rails 154 can travel within cylindrical walls 156, that is, to accurately position hand rails 154 at a particular location. The opposite ends of the hand rails 154, as is conventional, extend to the skirt of the inground pool and are mounted in the concrete thereat.

Figure 22:
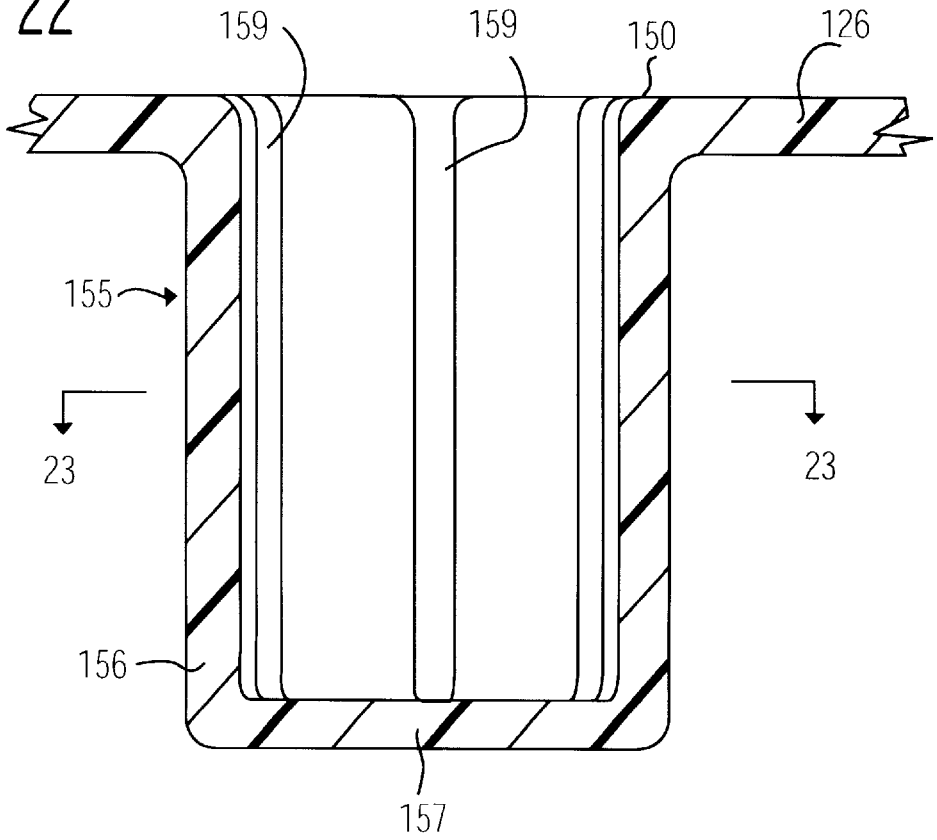
FIG. 22 is a cross-step sectional view of the lower step section of FIG. 19, taken along line 22—22 thereof.
Figure 23:
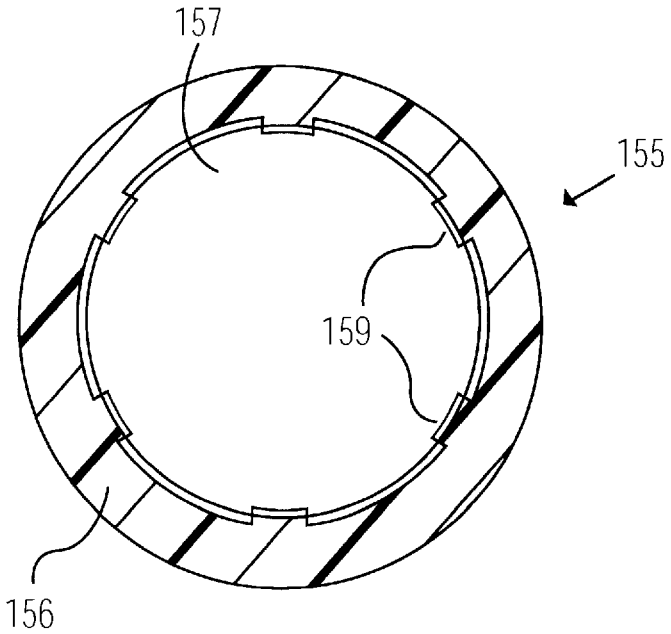
FIG. 23 is a cross-step sectional view of the lower step section of FIG. 22, taken along line 23—23 thereof.
Figure 24:
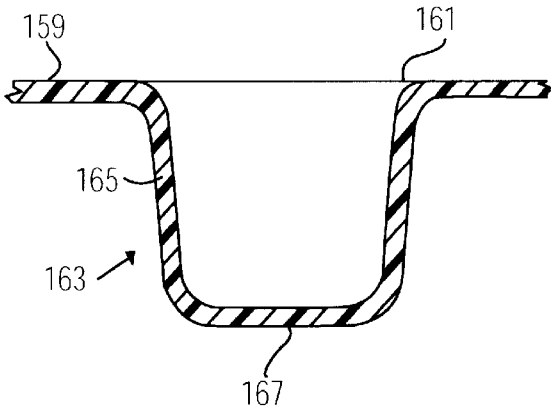
FIG. 24 is a cross-sectional view of the lower step section of FIG. 19, taken along line 24—24 thereof.
Figure 25:
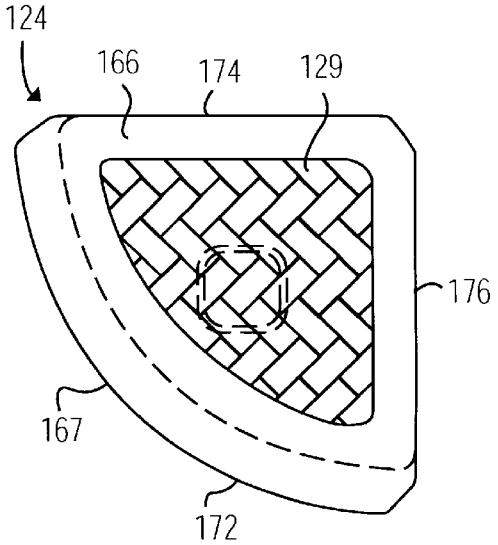
FIG. 25 is a top plan view of the upper step section of the step assembly of FIG. 17.
Figure 26:
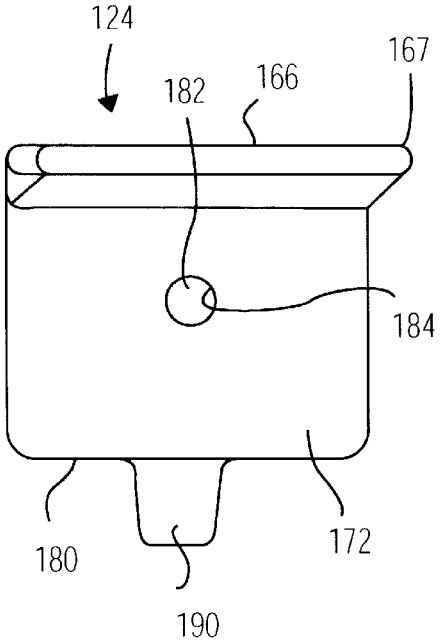
FIG. 26 is a front elevational view of the upper step section of FIG. 25.
Figure 27:
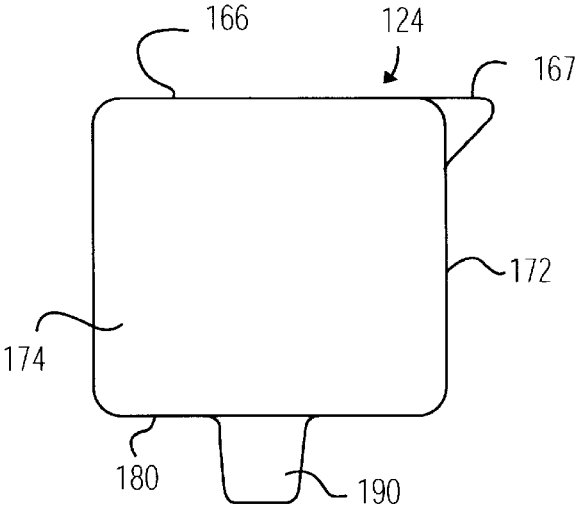
FIG. 27 is a side elevational view of the upper step section of FIG. 25.

As shown best in FIGS. 22 and 23, the inner surface of each cylindrical wall 156 slopes slightly inwardly, and is formed with equiangularly spaced, lengthwise extending ribs 159. Hand rails 154 include a complementary formation on the outer surface thereof, so as to prevent turning of the hand rails 154 within cup-shaped, cylindrical walls 156. Thus, a person walking up or down the steps can grasp hand rails 154 for better support. Screws or bolts can further be provided through cylindrical walls 156, and then through hand rails 154 to lock the same in place.

In accordance with another important aspect of the present invention, uppermost step 126 is formed as a front curved or arcuate part of a one-quarter sector, upper platform 159 of lower step section 122. A square opening 161 is provided in upper platform 159 to the rear of uppermost step 126. A thin walled, cup-shaped member 163 includes a cylindrical wall 165 closed by a bottom wall 167 for holding upper step section 124 thereon in a fixed position. Cylindrical wall 163 depends down from the underside of upper platform 159 in surrounding relation to opening 161 and is open only at the upper end thereof. Alternatively, cup-shaped member 163 can be eliminated entirely.

Referring now to FIGS. 17, 18 and 25–27, upper step section 124 includes a single step, although a plurality of steps can be provided within the scope of the present invention. Upper step section 124 is shown with a single step 166 formed in a one-quarter sector configuration, although the present invention is not limited thereto, so that step 166 can be formed in any other suitable configuration, such as rectangular, oval, etc. It will be appreciated that step 166 is higher than uppermost step 126 of lower step section 122, and forms a next step after step 126.

Step 166 has an outwardly extending lip 167 at the front arcuate edge thereof, to prevent slipping by a person, and the upper surface of step 166 also includes the same non-smooth, crisscrossing rectangular pattern (checkerboard tread) 129, ribs or the like, to prevent slipping.

A supporting structure for supporting step 166 is provided by an arcuate vertical front wall or front riser 172, and left and right vertical side walls 174 and 176. Front riser 172 is connected at its upper edge to the front edge of step 166, and its lower edge provides support for upper step section 124 on platform 159 of lower step section 122. Left and right vertical side walls 174 and 176 are connected at their front edges to the side edges of arcuate front riser 172, at their rear edges to each other, and at their upper edges to the side edges of step 166. The supporting structure also includes a bottom wall 180 connected at its edges to the lower edges of arcuate front riser 172, and left and right vertical side walls 174 and 176.

It is important that the outer dimensions of upper step section 124 are less than those of opening 144 in bottom wall 140 of lower step section 122, so that upper step section 124 can fit within lower step section 122 for storage and shipping.

Upper step section 124 is made from a thin walled, plastic material, and therefore forms a hollow chamber 182 therein.

When upper step section 124 is placed in the water in a swimming pool, it is necessary that the water be displaced. In order to aid in the insertion of upper step section 124, and the displacement of the water, arcuate front riser 172 and/or side walls 174 and 176 has at least one, and preferably more than one, opening 184 therein by which the water can escape into chamber 182. Such openings 184 also relieve the pressure on front riser 172 and side walls 174 and 176 during such insertion.

In accordance with another important aspect of the present invention, bottom wall 180 is provided with an elongated, downwardly extending plastic dowel member 190 integrally formed therewith. Dowel member 190 has a substantially square cross-sectional configuration of similar dimensions and shape to cup-shaped member 163 for fitting therein in a friction tight manner.

In order to assemble lower step section 122 and upper step section 124, sealed bags of sand or the like are placed in lower step section 122, and then lower step section 122 is positioned on the floor of the swimming pool. The water in chamber 142 and the sand bags retain lower step section 122 on the floor of the swimming pool. Then, upper step section 124 is positioned in the swimming pool, such that dowel member 190 fits within cup-shaped member 163 with a friction fit. Because of this friction fit and because of the water weight, due to the water entering chamber 182 of upper step section 124 through openings 184, upper step section 124 remains connected with lower step section 122. Hand rails 154 can be inserted before or after positioning of lower and upper step sections 122 and 124 into the swimming pool. Step assembly 120 can be moved a small amount into position such that lower portions 134*a* and 136*a* of vertical side walls 134 and 136 are against the side walls at the corner of the swimming pool. It will therefore be appreciated that set up of step assembly 120 is relatively easy.

Further, as with the first embodiment, during storage and during shipping, upper step section 124 fits within lower step section 122, that is, through large opening 144 of bottom wall 140. Thus, step assembly 120, during storage and transport, occupies a much smaller space and can be shipped at a greatly reduced cost.

It will be appreciated that various modifications can be made to the invention within the scope of the claims. For example, the shape of step assembly 120 can be changed to a rounded or any other suitable shape. Further, although only two step sections 122 and 124 have been shown, the present invention is not limited thereto, and more than two sections can be provided which interfit within each other.

Further, opening 144 can be provided in side walls 134 or 136, or any other wall, for insertion of upper step section 124.

Figure 28:
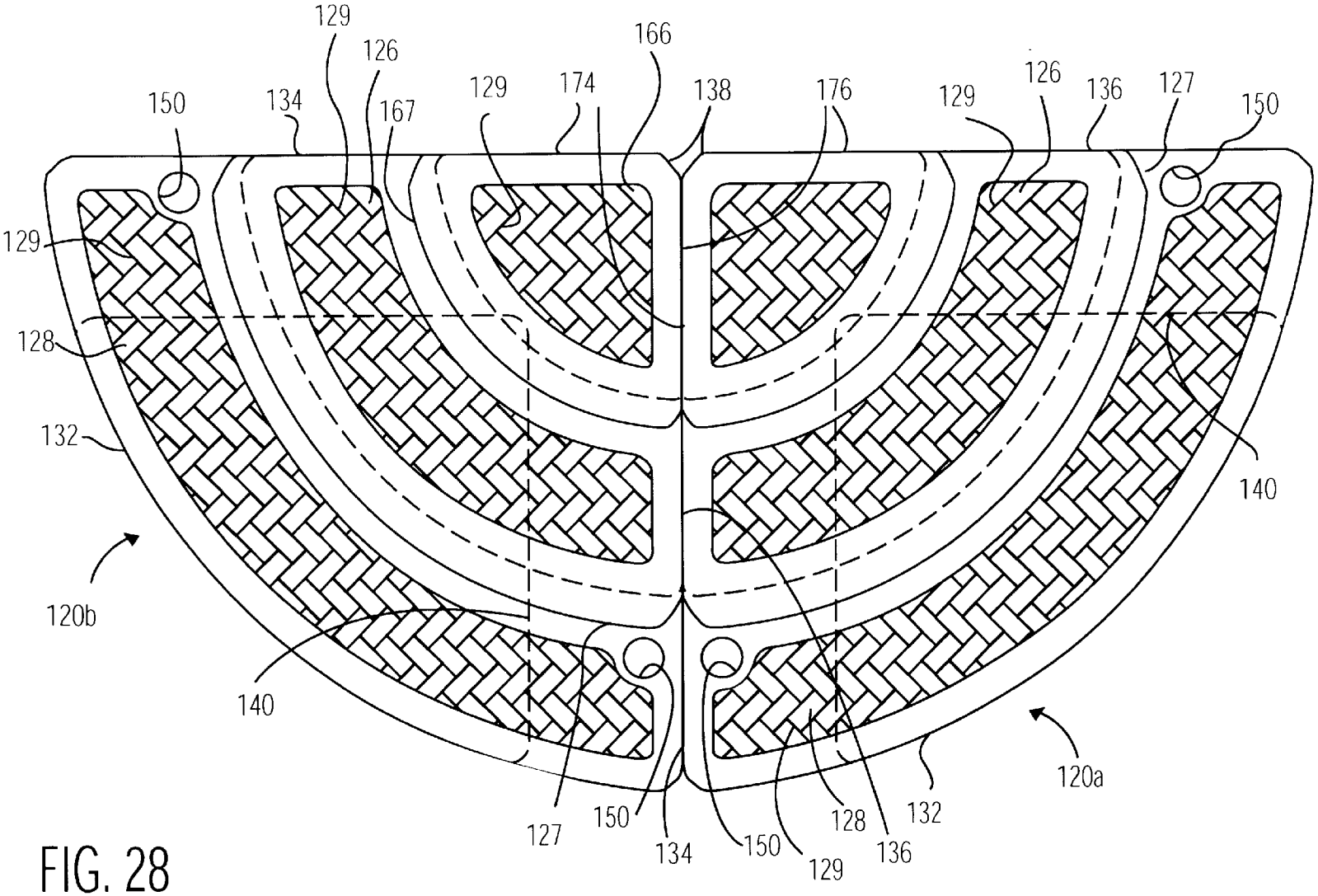
FIG. 28 is a top plan view of a step assembly for swimming pools according to a third embodiment of the present invention, in fully assembled condition.

Referring now to FIG. 28, there is shown a further modification of the present invention, in which two step assemblies 120*a* and 120*b* are placed side by side to form a semi-circular configuration. Step assemblies 120*a* and 120*b* can each be identical to step assembly 120 of FIGS. 17–27, although the present invention is not limited thereto.

In such case, side wall 134 of step assembly 120*a* can be detachably connected to side wall 136 of step assembly 120*b* by any suitable means such as the tongue and groove arrangement of the first embodiment of FIGS. 1–16, a clamp arrangement, a strap arrangement, a bolt fastening arrangement, etc.

Thus, with this latter embodiment, a large semi-circular step assembly, in plan view, can be constructed from two one-quarter sector step assemblies, thereby reducing the shipping size of any package. In such case, steps 126, 128 and 166 of step assemblies 120*a* and 120*b* form continuations of each other at the same heights.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A step assembly for a swimming pool, comprising:

a unitary, one-piece, molded plastic, stand alone, lower step section including:

at least one lower step, each at least at a first height, an upper platform at least as high as an uppermost one of said at least one lower step, a first supporting structure for supporting said at least one lower step and said upper platform on a ground surface as a stand alone unit without any further supporting structure, a first hollow chamber defined between said first supporting structure, said at least one lower step and said upper platform, and a first opening in a wall of the lower step section for permitting access to said first hollow chamber;

a unitary, one-piece, molded plastic upper step section including:

at least one upper step, each said upper step at a height greater than said upper platform, a second supporting structure for supporting said at least one upper step on said upper platform, a second hollow chamber defined between said second supporting structure and said at least one upper step, and a second opening in said second supporting structure for permitting water access to said second hollow chamber when said step assembly is positioned in a swimming pool, and said upper step section having dimensions less than said first opening so as to be inserted through said first opening when disassembled from said lower step section and so as to be entirely removably positioned in said first hollow chamber in a disassembled position for storage and shipping; and a securing assembly for removably securing said upper step section with said lower step section in an assembled position such that said second supporting structure is removably mounted on said upper platform and such that said steps of said lower step section and said upper step section form a sequential order of steps of different heights from a low height to a higher height.

2. A step assembly according to claim 1, wherein said at least one lower step includes two steps of different heights which are offset from each other in a horizontal direction and which are connected to each other by a riser.

3. A step assembly according to claim 2, further comprising at least one hand rail, and wherein said lower step section further includes hand rail holding sections for holding said at least one hand rail thereon.

4. A step assembly according to claim 3, wherein there are at least two hand rail holding sections, each including a cup-shaped wall for receiving an end of one said hand rail therein.

5. A step assembly according to claim 1, wherein said lower step section has a sector shape in plan view, and said first supporting structure includes an arcuate front wall connected with said at least one lower step, and first and second side walls connected with said at least one lower step and having first ends connected with said arcuate front wall and opposite second ends connected with each other.

6. A step assembly according to claim 5, wherein said first supporting structure further includes a bottom wall connecting lower edges of said front wall and said side walls, said bottom wall having said first opening therein.

7. A step assembly according to claim 6, wherein said first opening is a sector shaped opening.

8. A step assembly according to claim 1, wherein said upper step section has a sector shape in plan view, and said second supporting structure includes an arcuate front wall connected with said at least upper step, and first and second side walls connected with said at least one upper step and having first ends connected with said arcuate front wall and opposite second ends connected with each other.

9. A step assembly according to claim 8, wherein said second supporting structure further includes a bottom wall connecting lower edges of said front wall and said side walls.

10. A step assembly according to claim 1, wherein said second supporting structure includes at least one side wall connected at an upper end thereof with said at least upper step, and a bottom wall connected to a lower edge of said at least one side wall and which rests on said upper platform in the assembled position.

11. A step assembly according to claim 1, wherein said securing assembly includes:

a first securing device on said upper platform; and a second securing device on said second supporting structure for engaging with said first securing device to releasably secure said upper step section with said lower step section.

12. A step assembly according to claim 11, wherein said first securing device includes an upper opening in said platform, and said second securing device includes a dowel member integrally formed with said bottom wall as a one-piece member and which removably fits within said upper opening in the assembled position.

13. A step assembly according to claim 12, wherein said first securing device further includes a cup-shaped member at an underside of said upper platform and within said first chamber, said cup-shaped member surrounding said upper opening and being in open communication therewith at an upper edge of said cup-shaped member, for receiving said dowel member inserted through said upper opening.

14. A step assembly according to claim 13, wherein said dowel member has similar dimensions and shape to said cup-shaped member so as to removably fit within said cup-shaped member with a friction fit.

15. A step assembly according to claim 1, wherein two said step assemblies can be connected together to form a larger step assembly.

* * * * *